US005704903A

United States Patent [19]

Jahnke

[11] Patent Number: 5,704,903

[45] Date of Patent: Jan. 6, 1998

[54] WALL MOUNTED BACK SCRUBBER DEVICE

[76] Inventor: Wayne L. Jahnke, W43853 Business Hwy. #51, Merrill, Wis. 54452

[21] Appl. No.: 625,373

[22] Filed: Apr. 1, 1996

[51] Int. Cl.[6] ..... A61H 7/00; A61H 19/00

[52] U.S. Cl. ..... 601/97; 4/606

[58] Field of Search ..... 601/46, 97, 138, 601/155, 160, 158, 105; 4/606, 559; 15/21.1, 97.1, 104.92

[56] References Cited

U.S. PATENT DOCUMENTS

| | | | |
|---|---|---|---|
| 964,843 | 7/1910 | Booth | 4/559 |
| 3,057,348 | 10/1962 | Baer | 601/46 |
| 3,078,484 | 2/1963 | Briggs | 4/606 |
| 3,109,177 | 11/1963 | Grafmyer | 601/97 |
| 3,289,215 | 12/1966 | Kennedy | 4/606 |
| 3,943,921 | 3/1976 | Colk | 4/559 |
| 4,020,519 | 5/1977 | Robison | 4/606 |
| 4,040,132 | 8/1977 | Braun | 4/606 |
| 4,055,169 | 10/1977 | Baker et al. | 601/46 |
| 4,704,756 | 11/1987 | Williams et al. | 4/606 |
| 4,817,227 | 4/1989 | Scott | 601/97 |

*Primary Examiner*—Robert A. Hafer
*Assistant Examiner*—Justine R. Yu
*Attorney, Agent, or Firm*—Herman H. Bains

[57] ABSTRACT

A wall mounted back scrubber device includes a generally U-shaped mounting member including a central web portion, a pair of leg portions integral with the web portion, and a pair of outturned flanges integral with the leg portions. Suitable securing means are provided for securing the mounting on a vertical wall. An attachment plate is detachably secured to the mounting member by hooks which project through openings in the mounting member. Sponges formed from soft plastic mesh strips wound into rolls are connected to the attachment plate by the strips. In one embodiment a battery driven vibrator engages the mounting member to impart a vibratory motion to the back scrubber device.

3 Claims, 2 Drawing Sheets

WALL MOUNTED BACK SCRUBBER DEVICE

FIELD OF THE INVENTION

This invention relates to a back scrubber device and more particularly to a wall mounted back scrubber device.

BACKGROUND OF THE INVENTION

Back scrubber type implements are known in the prior art but many of these prior art devices are hand held implements. Such implements usually have rigid back engaging elements or body engaging elements that are not effective or/body-friendly.

SUMMARY OF THE INVENTION

It is an object of this invention to provide a novel and improved wall mounted back scrubber device which permits a user to effectively scrub the user's back.

A more specific object of this invention is to provide a novel and improved wall-mounted back scrubber device including a vibrating mechanism which imparts a vibratory action to a sponge-carrying attachment plate.

The back scrubber device includes a mounting member of generally U-shaped configuration which is mounted on a vertical wall, such as a shower stall wall or other suitable bathroom wall. An attachment plate is detachably secured to the mounting member and has a plurality of sponges connected thereto. The sponges are formed from soft plastic mesh material which is wound into a roll. In one embodiment, a battery driven vibrator engages the mounting member and imparts a vibratory action to the sponges when the vibrator is energized.

DESCRIPTION OF THE PREFERRED EMBODIMENT

Figures 1, 2:
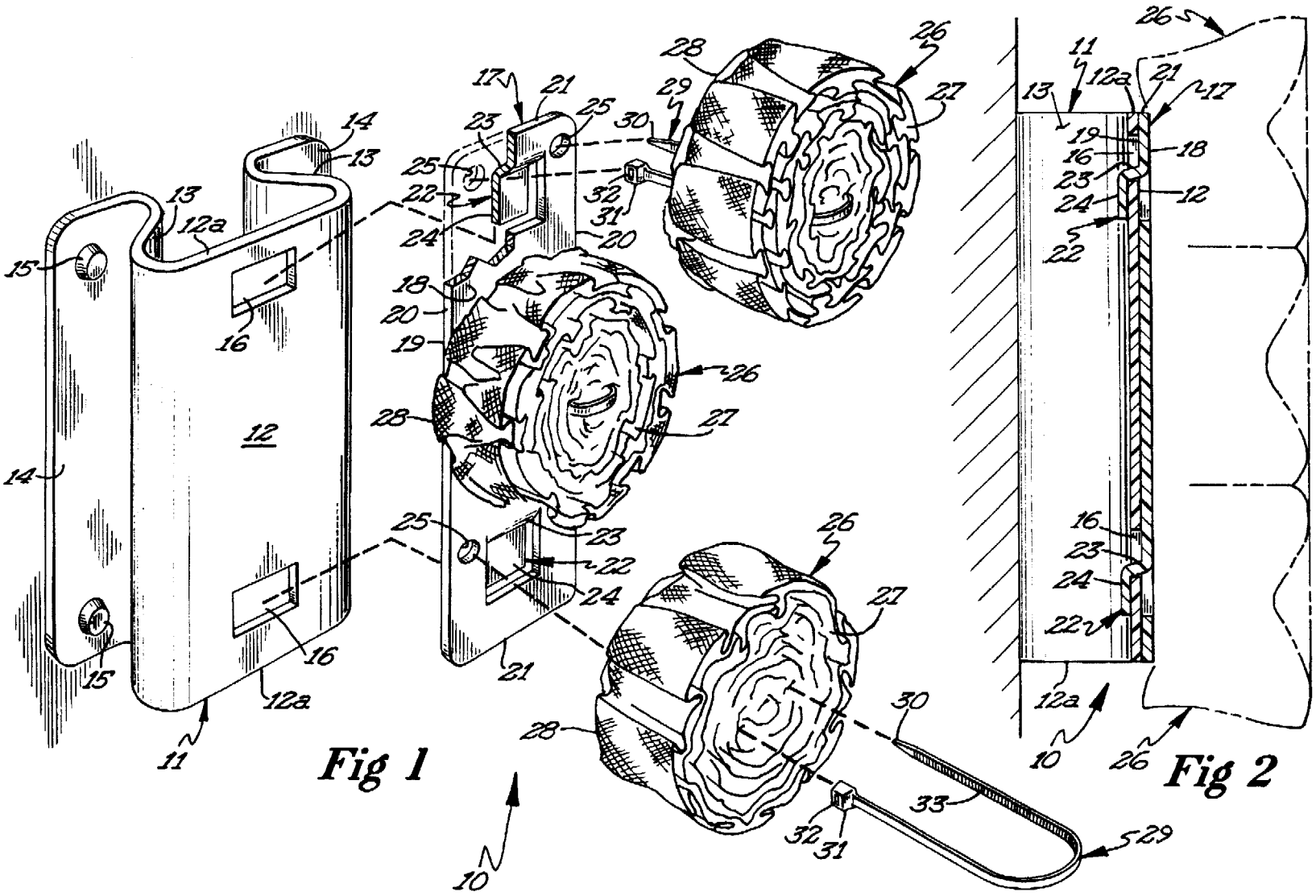
FIG. 1 is an exploded perspective view of the novel back scrubber device.
FIG. 2 is a cross sectional view of the back scrubber device with the sponges illustrated in phantom line configuration.

Referring now to FIGS. 1 and 2, it will be seen that one embodiment of the wall mounted back scrubber device, designated generally by the reference numeral 10, is thereshown. The back scrubber device 10 includes a generally U-shaped mounting member 11 having a generally flat web portion 12 which is integral with leg portions 13 that converge towards each other. Outturned flanges 14 are integral with the leg portions 13 and the outturned flanges 14 have openings therein for accommodating bolts 15 which secure the mounting member to a vertical wall. However, the mounting member 11 may be secured to the vertical wall of a shower stall or any suitable wall in the bathroom or other location.

The web portion 12 has a pair of vertically spaced apart generally rectangularly shaped openings 16 therein. It is pointed out that securing means other than bolts may be used to secure the mounting member to a vertical wall including suction cups, adhesive strips or similar type securing means. It is also pointed out that the mounting member 11 is preferably formed of a rigid plastic material such as polypropylene or the like but other plastic materials such as styrofoam may also be used. The mounting member may also be formed wire construction but having the same overall general configuration as that illustrated in the embodiment of FIG. 1.

The back scrubber device 10 includes a generally rectangular flat attachment member or plate 17, also formed of a rigid plastic material and having a substantially flat front surface 18, a substantially flat rear surface 19, straight longitudinal edges 20 and transverse edges 21.

The attachment member 17 also includes a pair of rearwardly projecting vertically spaced apart offset hooks 22 each including a rearwardly extending portion 23 and a vertical portion 24. The attachment member is provided with three pairs of transversely spaced, vertically arranged openings 25 therethrough.

A plurality of sponges 26, each being formed of soft plastic mesh material such as nylon or the like, are secured to the attachment plate 17. In forming the sponges, a soft plastic mesh strip is wound into a roll and then gathered and sewn together to present a front surface 27 and a back surface 28. It will be appreciated that these surfaces are irregular but such sponges are effective for use in scrubbing a user's body.

Means are provided for connecting the sponges to the attachment plate 17 and this means includes an elongate U-shaped plastic tie strip 29 for each sponge 26. In the embodiment, three such sponges are provided for the attachment plate. Each tie strip 29 is of elongate configuration and is provided with a pointed end 30 and an enlarged end 31 having an opening 32 therein. The ends of the U-shaped tie strip penetrate the sponge so that the bight or web portion thereof engages the front surface and the ends of the tie strip pass through a pair of the openings 25. The pointed end 30 is then passed through the opening 32 and is secured therein by engagement of serrations 33 with the inner surface of the opening through the enlarged portion 31. It will be noted that the serrations 33 are on the inner surface of each tie strip 29.

The attachment plate 17 having the sponges attached thereto will be releasably secured to the mounting member 11 by means of the hooks 22. It will be seen that the hooks 22 will be passed through the openings 16 in the mounting member and will be moved downwardly until the rearwardly extending portion engages the lower edge defining each opening. When this occurs, it will be noted that the upper and lower transverse edge of the attachment plate will be disposed in planar relation respectively with the upper and lower transverse edges 12*a* of the mounting member 11.

In use, the user will engage the sponges 26 of the back scrubber device with the user's back and by moving the back in a desirable fashion, the user can scrub the back in a very effective manner.

Figure 3:
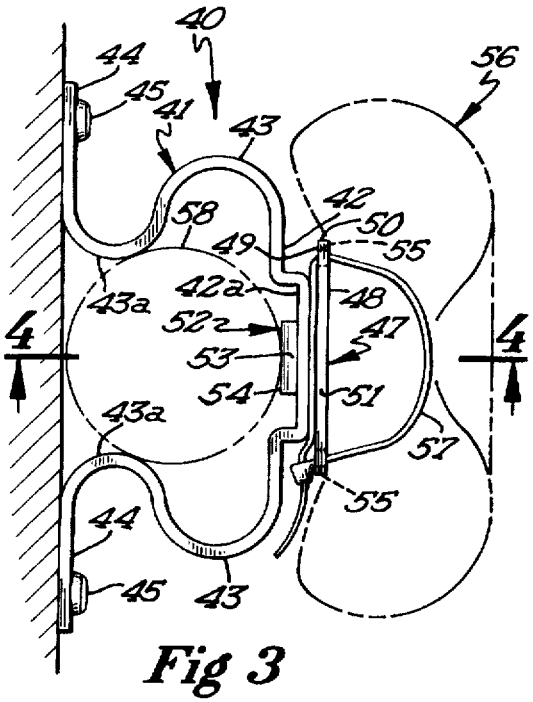
FIG. 3 is an end elevational view of a different embodiment of the back scrubber device.
Figure 4:
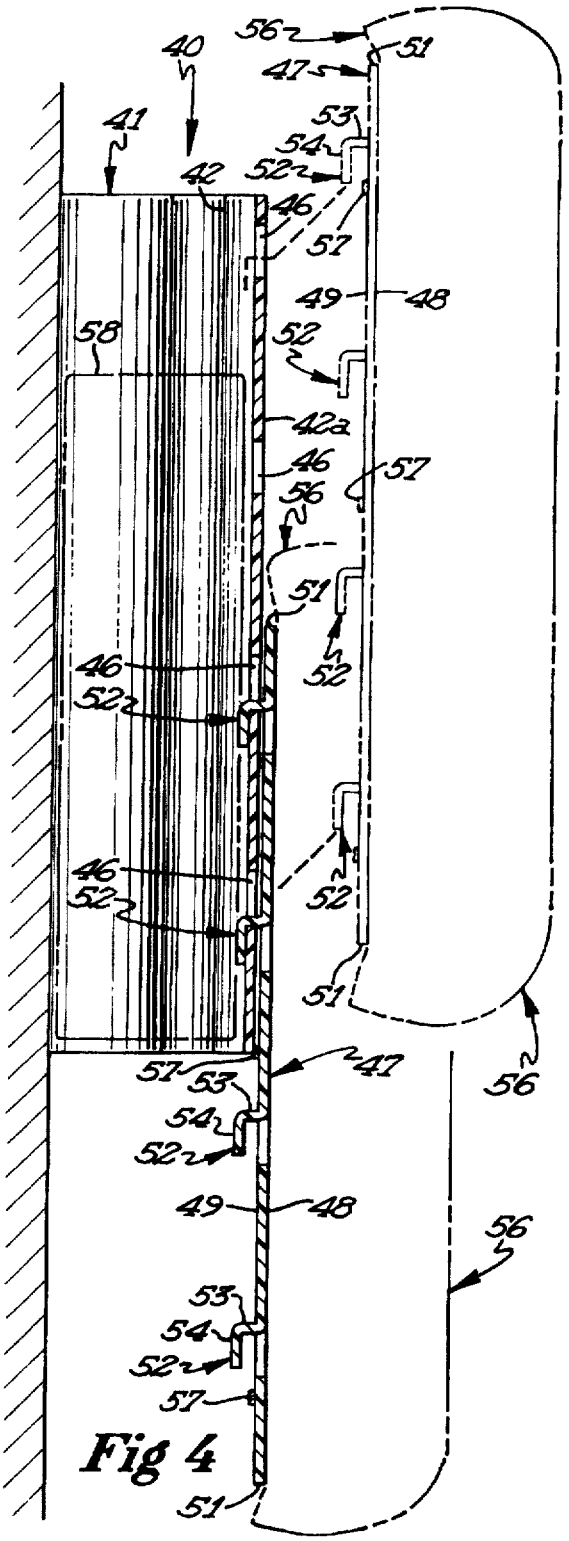
FIG. 4 is a cross sectional view taken approximately along line 4—4 of FIG. 3 and looking in the direction of the arrows with certain parts thereof illustrated in an adjusted position by phantom line configuration.

Referring now to FIGS. 3 and 4, it will be seen that a different embodiment of the back scrubber device, designated generally by the reference numeral 40, is thereshown. The back scrubber device 40 includes a generally U-shaped mounting member 41 including a flat web portion 42 having leg portions 43 integrally formed therewith and diverging inwardly towards each other. It will be noted that the flat web portion includes an outwardly offset substantially flat central portion 42*a*. The leg portions are integral with a pair of outturned flanges 44 each having openings therein for accommodating securing means such as bolts 45. It is again pointed out that other suitable securing means such as suction cups, adhesive strips and the like may be used to secure the mounting member to a vertical wall such as the wall of a shower compartment.

The outwardly offset central portion 42*a* of the mounting member is provided with a plurality of vertically spaced apart rectangular openings 46 therein. In the embodiment shown, four such openings 46 are provided in the mounting member. It is also pointed out that the mounting member may also be formed of a suitable plastic material or other materials in the manner of the embodiment of FIG. 1.

The back scrubber device 40 also includes a generally rectangular shaped substantially flat attachment member or plate 47 having a substantially flat front surface, a substantially flat rear surface, straight longitudinal edges 50 and straight transverse edges 51. The attachment plate 47 is also provided with vertically spaced apart rearwardly projecting offset hooks 52 each including rearwardly extending portion 53 and a vertical portion 54. In the embodiment shown, four such hooks are provided. The attachment plate is also provided with a plurality of laterally spaced apart vertically arranged opening 55 in the manner of the embodiment of FIG. 1.

A plurality of sponges 56 are formed from a rolled or wound strip of plastic mesh and presenting front and rear surfaces in the manner of the embodiment of FIG. 1. The sponges are secured to the attachment plate by plastic tie strips 57 of identical construction to those of the embodiment of FIG. 1. When the attachment plate 47 is secured to the mounting member 41, each of the hooks 52 will project through and engage the lower edge defining an opening 46 to mount the attachment member on the mounting member. In the embodiment shown, the back scrubber device 40 is provided with a battery driven vibrator 58 which is positioned interiorly of the concavity of the mounting member 41 and engages some or all of the hooks 52 and the inwardly opposed convex surfaces 43*a* of the leg portions 43. Thus the vibrator is in firm contact with the mounting member.

Although not shown in the drawing, when the actuator switch of the vibrator is moved from the off to the on position, the vibrator will be energized and will vibrate and impart this vibratory motion to the mounting member. With this arrangement, the back scrubber device including the sponges 26 will vibrate. When a user contacts the sponges via the user's back while the vibrator is in an energized condition, the user will experience a vibratory effect from the back scrubber device.

Referring now to FIG. 4, it will be seen that the attachment plate 41 with the sponges attached thereto is illustrated in an exploded position and in an adjusted position by phantom line configuration. When the hooks 52 of the attachment plate project through and engage all of the openings 46 in the mounting member, the attachment plate will be in an upper position. This allows the upper back of a user to be scrubbed by the scrubber device. However, the attachment plate may be removed to permit the upper pair of hooks 52 to engage the two lower openings 46 in the mounting member as illustrated in phantom line configuration to dispose the sponge carrying attachment member in a lower position. With this arrangement, the back scrubber device may be used to effectively scrub the lower back of a user.

From the foregoing description, it will be noted that I have provided a more efficient wall mounted back scrubber device than any heretofore known comparable device.

What is claimed is:

1. A wall mounted back scrubber device for attachment to a vertical shower compartment, comprising;

a generally U-shaped mounting member including a central web portion, a pair of leg portions integral with said central web portion and extending therefrom and converging towards each other, substantially flat out turned flanges integral with the legs and extending outwardly therefrom, means engaging the flanges for securing the mounting member on a vertical wall, a substantially flat attachment member, a plurality of hook shaped elements integrally formed with said attachment member and a plurality of openings in said mounting member for receiving said hooks for detachably connecting the attachment member to said mounting member, a plurality of similar sponge members formed of a plastic mesh strip wound into a roll, fastening means engaging each sponge and said attachment member for attaching the sponges to the attachment member.

2. The wall mounted scrubber device as defined in claim 1 wherein each U-shaped mounting member defines a concavity, a vibrator device positioned within the concavity and engaging the mounting member when imparting a vibratory motion to the mounting member when the vibrator is energized.

3. A wall mounted back scrubber device for attachment to a vertical shower compartment, comprising;

a generally U-shaped mounting member including a central web portion, a pair of leg portions integral with said central web portion and extending therefrom and converging towards each other, substantially flat out turned flanges integral with the legs and extending outwardly therefrom, means engaging the flanges for securing the mounting member on a vertical wall, a substantially flat attachment member, and a plurality of connecting means on said mounting member for detachably connecting the attachment member to the mounting member, said attachment member having a plurality of openings thereon, a plurality of similar sponge members each formed of a plastic mesh strip wound into a roll, fastening means for securing each sponge to said attachment member comprising a plurality of U-shaped tie strips each having opposite ends thereof projecting through one of said sponge members, one end of each tie strip having an opening therein, the other end of each tie strip projecting through said opening for securing the ends of each tie strip together.

* * * * *